United States Patent [19]

Feldner

[11] Patent Number: 4,674,813

[45] Date of Patent: Jun. 23, 1987

[54] ELECTRICAL LOCK

[76] Inventor: Raymond Feldner, 10 Glacier Dr., Cinnaminson, N.J. 08077

[21] Appl. No.: 867,993

[22] Filed: May 27, 1986

[51] Int. Cl.[4] ..... H01R 13/639

[52] U.S. Cl. ..... 439/133; 439/147; 439/304

[58] Field of Search ..... 339/36, 37, 39, 75 P, 339/82, 28, 83–87, 123; 174/66, 67; 70/57, DIG. 72; 179/189 R

[56] References Cited

U.S. PATENT DOCUMENTS

| | | | |
|---|---|---|---|
| 4,134,045 | 1/1979 | Quin | 339/28 X |
| 4,424,407 | 1/1984 | Barbic | 174/67 |
| 4,479,688 | 10/1984 | Jennings | 339/37 |
| 4,531,794 | 7/1985 | Heverly | 339/39 |
| 4,584,430 | 4/1986 | Belknap | 339/37 X |
| 4,603,931 | 8/1986 | Ruffman | 339/37 |

FOREIGN PATENT DOCUMENTS

| | | | |
|---|---|---|---|
| 2158662 | 11/1985 | United Kingdom | 339/75 P |

*Primary Examiner*—Gil Weidenfeld
*Assistant Examiner*—Steven C. Bishop
*Attorney, Agent, or Firm*—Norman E. Lehrer

[57] ABSTRACT

A theft protection system for an electrical instrument includes a metal jacket power cord having an enlarged plug at each end. The base of a first locking device is secured to the instrument and one end of the cord is plugged into a socket on the instrument. Thereafter, a cover is placed over the plug and socket and is locked to the base with the cord passing through a slotted opening in the cover. A second base member in the form of a plate is secured to a standard duplex electrical outlet. The plug at the other end of the cord is inserted into the electrical socket and is then covered by a cover member which is locked to the base plate. The cord cannot be removed from the wall outlet or the instrument without unlocking the cover members.

5 Claims, 9 Drawing Figures

Fig. 1
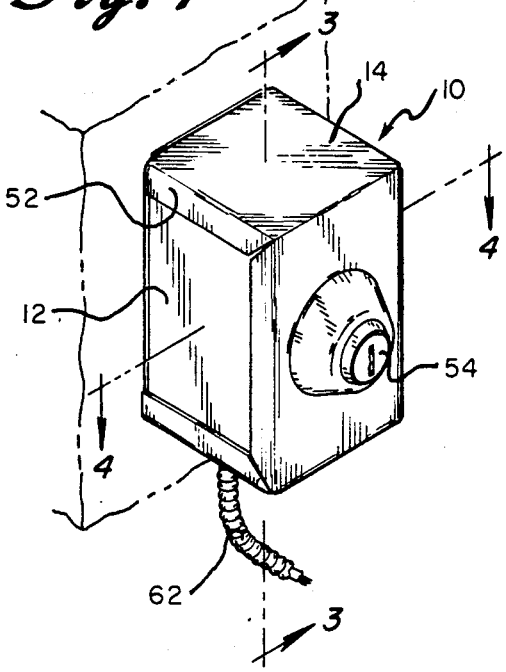
Fig. 3
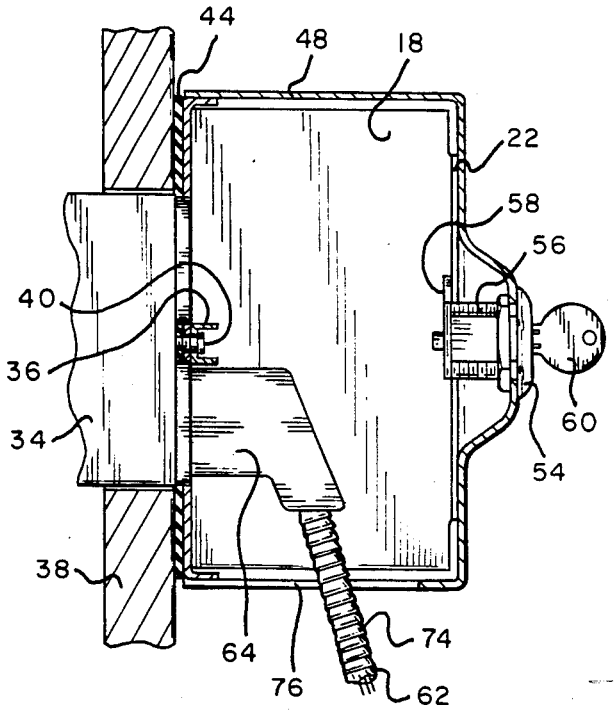
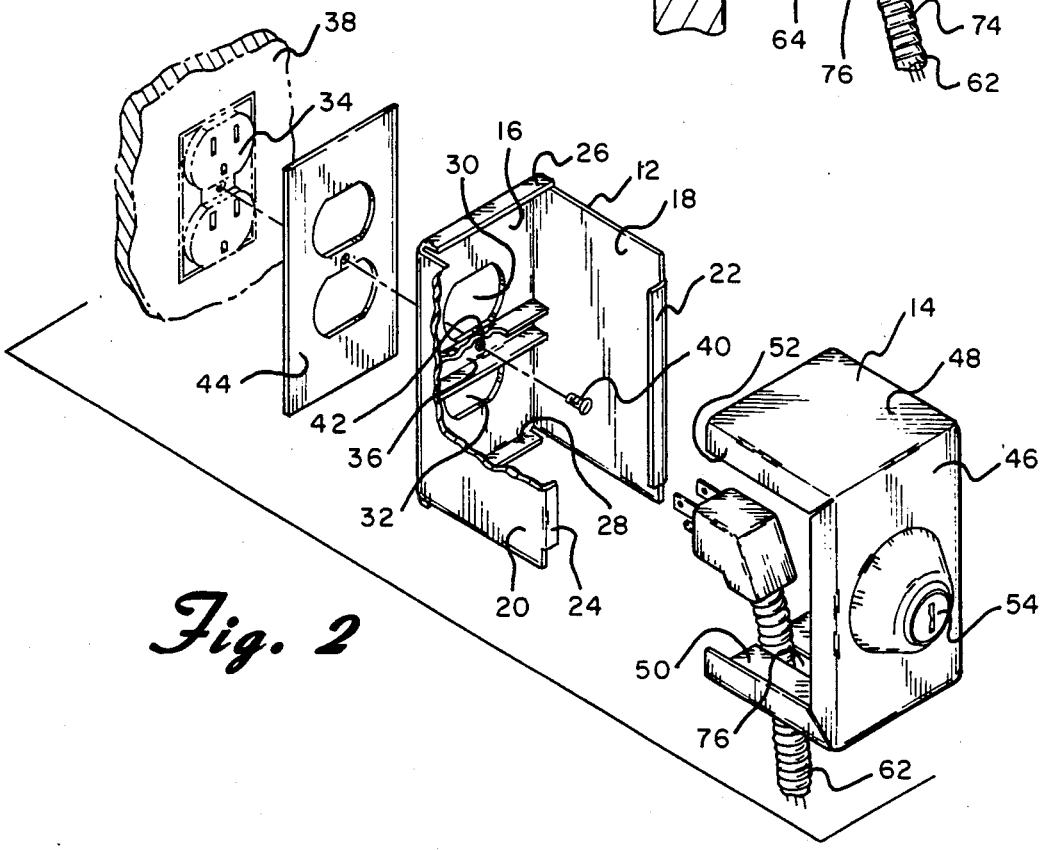
Fig. 2

Fig. 4
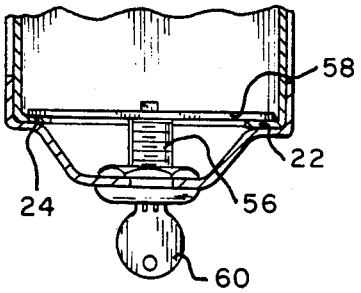
Fig. 5
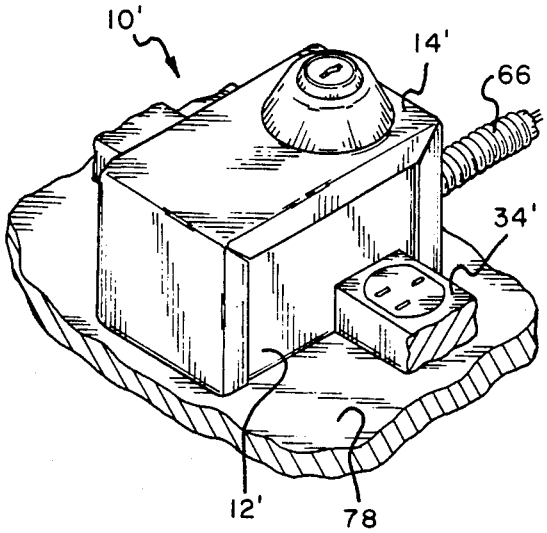
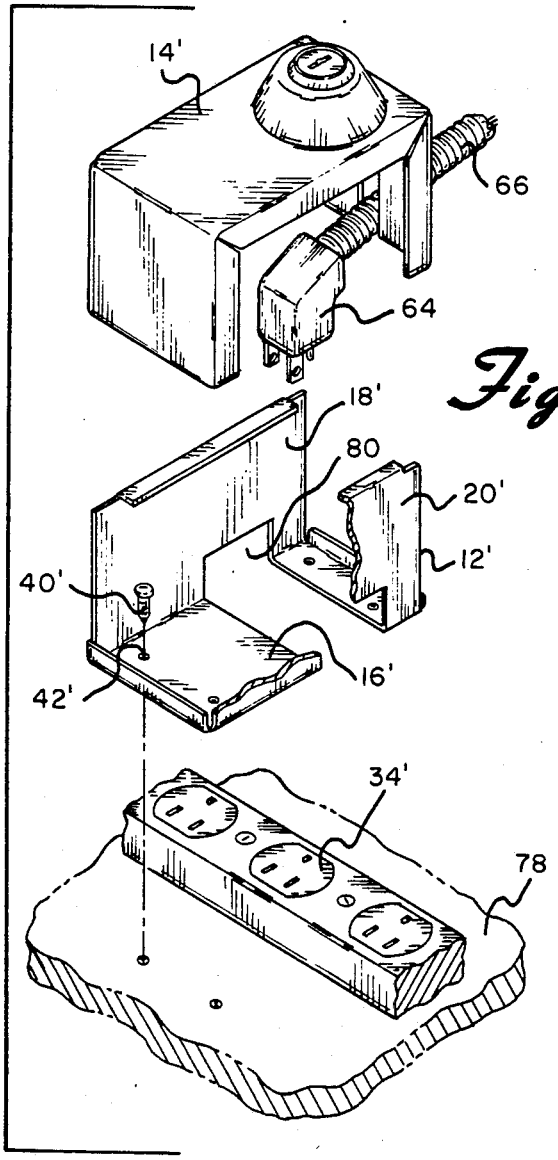
Fig. 6

ELECTRICAL LOCK

BACKGROUND OF THE INVENTION

The present invention is directed toward a theft protection system for an electrical instrument and more particularly toward such a system which includes a metal jacketed power cord with a plug at each end which are locked to the instrument and to the electrical wall outlet or other source of power.

In recent years, there has been a marked increase in the theft of expensive electrical laboratory apparatus such as balances, measuring apparatus and the like. These devices utilize standard electrical power cords which are plugged into an electrical wall outlet or a strip of outlets which may be mounted on a workbench or the like. Thieves simply unplug the power cord from the wall and walk out with the entire device including the power cord.

One attempted solution to the problem has been to bolt or otherwise permanently affix the apparatus to the workbench or laboratory table. While this has been of some benefit, it has not been widely adapted since it is inconvenient to have the piece of apparatus bolted or fixed in a particular location. It is often desirable to move the piece of apparatus from one place to another within a laboratory.

It has also been suggested to provide a housing around the electrical outlet which housing has a locking cover so that the plug from the electrical apparatus cannot be removed from the electrical outlet without unlocking the housing cover. Examples of such locking assemblies for electrical outlets are shown in U.S. Pat. Nos. 2,709,198; 3,200,989; 3,293,588 and 4,479,688. Such locking devices may have a slight deterrent effect but would not prevent the theft of relatively expensive laboratory apparatus. Such apparatus normally includes a plug at both ends of the power cord so that the plug at the apparatus itself could simply be unplugged by the thief or, utilizing a pair of wire cutters, he could simply cut the power cord and replace the same after stealing the apparatus.

SUMMARY OF THE INVENTION

The present invention is designed to overcome the problems of the prior art and to provide a system which will effectively prevent the theft of electrical instruments and other types of apparatus. The theft protection system of the invention includes a metal jacket power cord having an enlarged plug at each end. The base of a first locking device is secured to the instrument and one end of the cord is plugged into a socket on the instrument. Thereafter, a cover is placed over the plug and socket and is locked to the base with the cord passing through a slotted opening in the cover. A second base member in the form of a plate is secured to a standard duplex electrical outlet. The plug at the other end of the cord is inserted into the electrical socket and is then covered by a cover member which is locked to the base plate. The cord cannot be removed from the wall outlet or the instrument without unlocking the cover members.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

FIG. 1 is a perspective view of one portion of a theft prevention system constructed in accordance with the principles of the present invention;

FIG. 2 is an exploded view of the device shown in FIG. 1;

FIG. 3 is a cross-sectional view taken through the line 3—3 of FIG. 1;

FIG. 4 is a cross-sectional view taken through the line 4—4 of FIG. 1;

FIG. 5 is a perspective view similar to FIG. 1 showing a second form of the invention;

FIG. 6 is an exploded view of the device shown in FIG. 5;

DETAILED DESCRIPTION OF THE PREFERRED EMBODIMENT

Figure 7:
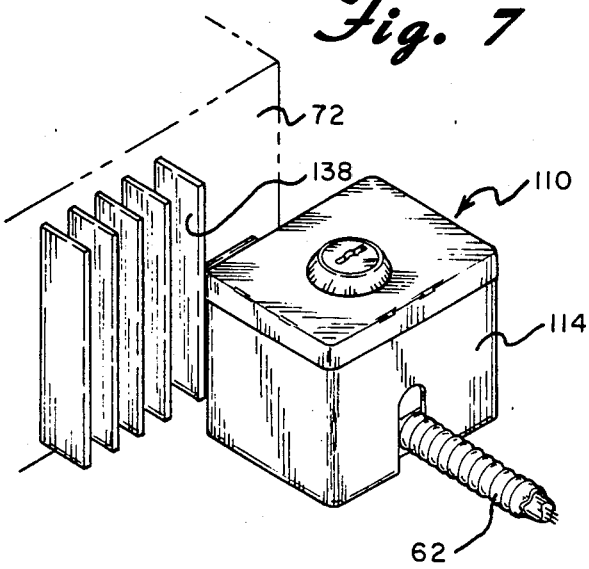
FIG. 7 is a perspective view of another portion of the theft protection system of the invention.

Referring now to the drawings in detail wherein like reference numerals have been used throughout the various figures to designate like elements, there is shown in FIG. 1 a first portion of a theft protection system for an electrical instrument constructed in accordance with the principles of the present invention and designated generally as 10. The device shown in FIG. 1 is the first of two similarly constructed locking devices which, along with a power cord, make up the theft prevention system of the invention.

The first locking device 10 includes a base member 12 and a cover member 14. Base member 12 is comprised of a substantially rectangularly shaped base plate 16 and upstanding side walls 18 and 20. The free ends of the side walls 18 and 20 are turned inwardly to form flanges 22 and 24. Similar flanges 26 and 28 are formed at the top and bottom of plate 16. The base plate 16 also includes a pair of openings 30 and 32 which are adapted to fit around a standard duplex electrical outlet such as shown at 34 in FIG. 2. In order to increase the structural rigidity of the base plate 16, a small piece of angle iron 36 is positioned across the center of the plate. The base member 12 can be secured to a wall 38 through the use of a screw 40 which passes through a centrally located opening 42 in the angle iron 36 and a corresponding opening in the base plate 16. The screw 40 is then screwed into the central screw opening in the duplex outlet 34. A gasket 44 comprised of hard rubber or the like is interposed between the base plate 16 and the wall 38. This not only allows for a better fit but prevents marring of the wall and also makes it more difficult for a would-be thief to insert a screwdriver or similar tool between the base member 12 and the wall 38 to pry the same away from the wall.

The cover member 14 includes a front wall 46 and outwardly extending top and bottom walls 48 and 50. Flanges such as flange 52 extend from each of the walls 46, 48 and 50. The interior dimensions of the cover member 14 are slightly larger than the overall exterior dimensions of the base member 12 so that the cover member 14 can be slid over the base member. When the cover member 14 is in place, the flanges 26, 28 and 52 help to prevent the insertion of a screwdriver or other tool between the base and cover members so that the same cannot be pried apart.

The cover member 14 also carries a key lock 54. As shown most clearly in FIGS. 3 and 4, the key lock 54 includes a cylinder 56 which extends inwardly and carries a rotatable elongated keeper or locking member 58. Utilizing the key 60, the locking member 58 can be rotated from a first, inoperative position, which would be a vertical orientation as viewed in FIGS. 1, 2 and 3 to a horizontal locking posi- tion. When the cover member 14 is placed over the base member 12, the ends of the locking member 58 underlie the flanges 22 and 24 to lock the cover member 14 to the base member 12.

Figure 8:
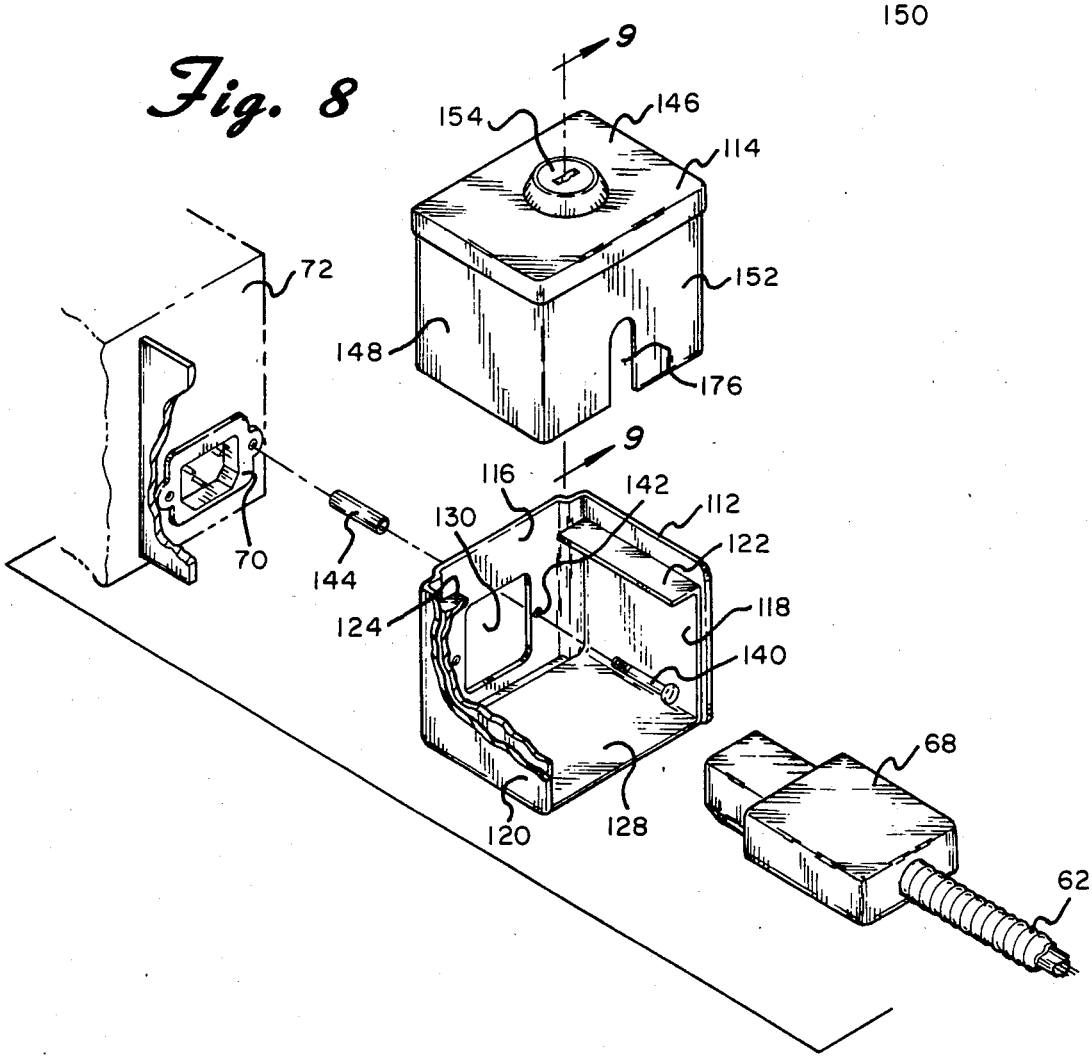
FIG. 8 is an exploded view of the device shown in FIG. 7.

The theft prevention system of the present invention also includes an electrical power cord 62 which has an en- larged male plug 64 at one end thereof and an enlarged female plug 68 (see FIG. 8) at the other end thereof. Plug 64 is a standard three-prong plug which is adapted to be plugged into a standard electrical outlet 34. Plug 68, on the other hand, is a standard equipment plug which is adapted to be inserted into the power inlet socket 70 of an electrical instrument 72 (FIGS. 7 and 8). A power cord 62 includes a spiral metal jacket 74 therearound which is designed to be strong enough so that the same cannot be cut utilizing standard wire or cable cutters or the like.

The first locking device 10 is utilized by first securing the base member 12 to the wall 38 through the use of the screw 40. This is done after the standard cover plate is removed from the duplex outlet 34. The plug 64 of the power cord 62 is then plugged into the electrical outlet through the openings 30 or 32 in the base plate 16. The cover member 14 is then inserted over the base member 12. As shown most clearly in FIG. 2, the wall 50 of the cover member 14 includes an elongated slotted opening 76 which allows the cord 62 to pass therethrough. The slot 76, however, is not wide enough to allow the plug 64 to pass through. With the cover member 14 in its proper position on the base member 12, key 60 is turned thereby rotating the locking member 58 into position under the flanges 22 and 24. The plug 64 cannot now be removed either from the electrical outlet 34 or from the interior of the locking device 10 without utilizing key 60 to remove the cover member 14.

Another embodiment of the first locking device 10 is shown in FIGS. 5 and 6 and is designated as 10'. The locking device 10' is constructed substantially identically to the device 10 described above except that it is adapted to be utilized with a strip type electrical outlet 34' which is commonly used on a laboratory or workbench 78. The cover member 14' is substantially identical to cover member 14. The base member 12' is similar to the base member 12 except that, in lieu of the openings 30 and 32, a rectangular-shaped opening 80 is formed in the base plate 16' and partially up the side walls 18' and 20'.

The base plate 16' includes a plurality of holes 42' passing therethrough. A plurality of screws such as screws 40' pass through the opening 42' and secure the base member 12' to the laboratory table 78 with the strip electrical outlet 34' fitting within the rectangular opening 80 as shown in FIG. 5. Thereafter, the device 10' is utilized in substantially the same manner as device 10 with the plug 64 being inserted into the outlet 34' and the cover member 14' being locked into place as with the first embodiment.

Figure 9:
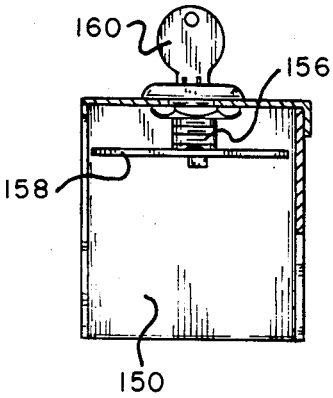
FIG. 9 is a cross-sectional view taken through the line 9—9 of FIG. 8.

The second locking device utilized with the present invention at the electrical instrument end of the power cord 62 is shown in FIGS. 7, 8 and 9 and is designated generally as 110. The locking device 110 is similar in principle to the previously described devices 10 and 10'.

The locking device 110 includes a base member 112 and a cover member 114. Base member 112 includes a base plate 116, side walls 118 and 120 and a bottom wall 128. Extending inwardly near the top of the side walls 118 and 120 are flanges 122 and 124. A rectangularly shaped opening 130 is formed in the base plate 116 and is adapted to overlie the electrical socket 70 on the instrument 72. The base member 112 is held in place through the use of screws 140 which pass through openings 142 in the base plate 116. The screws 140 are then, in turn, secured to the socket 70 in a known manner.

In many cases, the base plate 116 of the base member 112 will be able to be arranged substantially flush against the socket 70. In some applications, however, there may be some device mounted on the instrument 72 adjacent the socket 70 which may prevent the base member 112 from being mounted flush to the socket. In the embodiment shown in FIGS. 7 and 8, for example, heat sink 138 extends outwardly from the rear of the instrument 72 and interferes with the placement of the base member. Under such circumstances, standoffs 144 of appropriate length may be utilized to properly position the base member 112. In lieu of the smaller standoffs 144 which allow the screws 140 to pass therethrough, it may be desirable to utilize a larger tubularly shaped member which may encircle the entire socket 70 including the screws 140. Such an arrangement would make it more difficult for someone to use a hacksaw or the like to cut through the standoff 144 and the screws 140.

The cover member 114 includes a top face 146, side walls 148 and 150 and a front wall 152. Wall 152 includes an elongated slot 176 therein. The cover member 114 also includes a key lock 154 which, similar to lock 54, includes a cylinder 156 and a rotatable locking member 158. Utilizing a key 160, the locking member 158 can be rotated between an inoperative position wherein it is perpendicular to the instrument 72 and a locking position wherein it is parallel thereto. When the cover member 114 is in its proper position over the base member 112 and the key 160 is turned, the locking member 158 underlies the flanges 122 and 124 to maintain the cover member 114 in place.

The second locking device 110 is utilized in substantially the same manner as the first locking device 10 or 10'. After the base member 112 is secured to the instrument 72 utilizing the screws 140, the female plug 68 is plugged into the socket 70. The cover member 114 is then placed in position by sliding the same downwardly over the top of the base member 112. The plug 68 is then within the second locking device 110 with the cord 62 extending out through the slotted opening 176. The cover member 114 is locked in place by turning the key 160 which thereby rotates the locking element 158 under the flanges 122 and 124.

In the preferred embodiment of the invention, the locking devices 10, 10' and 110 are comprised of sheet metal. However, other suitable strong materials may also be useful. The present invention may be embodied in other specific forms without departing from the spirit or essential attributes thereof and accordingly reference should be made to the appended claims rather than to the foregoing specification as indicating the scope of the invention.

I claim:

1. A theft prevention system for an electrical instrument of the type which includes an electrical socket thereon which is adapted to be connected to a power cord for supplying electrical power to said instrument, said system comprising:

an electrical power cord having a metal jacket covering the same throughout substantially the entire length thereof, a first enlarged plug at one end of said cord adapted to be plugged into said electrical socket on said instrument and a second enlarged plug at the other end of said cord adapted to be plugged into a standard electrical power outlet;

first and second locking devices, each of which includes a base member and a cover member therefor;

the base member of said first locking device being secured to said instrument adjacent said socket;

the base member of said second locking device being secured to said electrical outlet;

a slotted opening associated with each locking device, each slotted opening allowing said power cord to pass therethrough but preventing the plugs from doing the same, and key locking means on each cover member locking the same to its respective base member whereby when said cover members are locked in place, said plugs cannot be unplugged and said locking devices and said cord physically secure said instrument to said outlet to prevent theft of said instrument.

2. The invention as claimed in claim 1 wherein said base member of said first locking device is adapted to be secured to said instrument through screws which normally secure said socket to said instrument.

3. The invention as claimed in claim 1 wherein said base member of said second locking device includes a substantially rectangularly shaped plate having a pair of openings therein adapted to overlie the electrical sockets of a duplex outlet, said plate having a substantially centrally located screw opening through which said plate can be secured to said duplex outlet.

4. The invention as claimed in claim 3 further including a substantially rigid reinforcing bar mounted on said plate adjacent said screw opening.

5. The invention as claimed in claim 3 further including a compressible foam gasket member interposed between said plate and said duplex outlet.

* * * * *